US011796242B2

(12) United States Patent
Anderson et al.

(10) Patent No.: US 11,796,242 B2
(45) Date of Patent: Oct. 24, 2023

(54) AIR VENT FOR A REFRIGERATION APPLIANCE

(71) Applicant: Haier US Appliance Solutions, Inc., Wilmington, DE (US)

(72) Inventors: Ronald Kenneth Anderson, Sidney, OH (US); Martin Busche, Evansville, IN (US); Zachary Michael Eagleson, Newburgh, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 198 days.

(21) Appl. No.: 17/340,454

(22) Filed: Jun. 7, 2021

(65) Prior Publication Data

US 2022/0390165 A1 Dec. 8, 2022

(51) Int. Cl.

*F25D 17/08* (2006.01)
*F25D 17/06* (2006.01)
*F25D 21/04* (2006.01)

(52) U.S. Cl.

CPC ..... *F25D 17/08* (2013.01); *F25D 17/062* (2013.01); *F25D 17/067* (2013.01); *F25D 21/04* (2013.01); *F25D 2317/067* (2013.01)

(58) Field of Classification Search

CPC ..... F25D 23/068; F25D 17/08; F25D 17/045; F25D 2317/0672; F25D 2317/0671; F25D 2317/067; F25D 2321/141; F25D 21/04; F25D 23/08; F25D 2323/02; F25D 23/066; F25D 23/00; F25D 17/062; F24F 13/06; F24F 2013/0616; F24F 13/08; F24F 13/02

See application file for complete search history.

(56) References Cited

U.S. PATENT DOCUMENTS

| | | | |
|---|---|---|---|
| 10,288,338 | B2 | 5/2019 | Bae |
| 2020/0386467 | A1 | 12/2020 | Candeo |

FOREIGN PATENT DOCUMENTS

| | | | | |
|---|---|---|---|---|
| CN | 106885425 | * | 6/2017 | ..... F25D 17/062 |
| EP | 2511620 | A2 | 10/2012 | |
| JP | 4848332 | B2 | 12/2011 | |
| WO | WO2007045870 | A2 | 4/2007 | |
| WO | WO2007138028 | A2 | 12/2007 | |

OTHER PUBLICATIONS

English language translation of CN 106885425. Translated Feb. 14, 2023 (Year: 2017).*

* cited by examiner

*Primary Examiner* — Cassey D Bauer
(74) *Attorney, Agent, or Firm* — Dority & Manning, P.A.

(57) ABSTRACT

A refrigeration appliance includes a cabinet having a plurality of walls that define a chilled chamber, a door attached to the cabinet to selectively restrict access to the chilled chamber, a cooling system for providing cool air to the chilled chamber via a duct extending through a wall of the plurality of walls of the chilled chamber, and at least one air vent positioned at an end of the duct. Further, the air vent(s) is mounted to the wall. Moreover, the air vent(s) has a body defining an opening through which the cool air exits during operation of the refrigeration appliance. The body of the air vent(s) further defines an outer perimeter having at least one discontinuity that creates at least one airflow passage between the body and the wall to reduce moisture in the chilled chamber.

19 Claims, 11 Drawing Sheets

AIR VENT FOR A REFRIGERATION APPLIANCE

FIELD OF THE INVENTION

The present subject matter relates generally to an air vent for a refrigeration appliance, such as a refrigerator or a freezer, and more particularly to a castellated air vent for a refrigeration appliance.

BACKGROUND OF THE INVENTION

Refrigeration appliances, such as refrigerators and/or freezers, generally include a cabinet that defines a chilled chamber. Thus, a wide variety of food items may be stored within the chilled chamber. The low temperature of the chilled chamber relative to ambient atmosphere assists with increasing a shelf life of the food items stored within the chilled chamber.

More specifically, certain refrigerator appliances utilize sealed systems for cooling the chilled chamber. A typical sealed system includes an evaporator and a fan, with the fan generating a flow of air across the evaporator and cooling the flow of air. The cooled air is then provided through an opening into the chilled chamber to maintain the chilled chamber at a desired temperature. Air from the chilled chamber is circulated back through a return duct to be re-cooled by the sealed system during operation of the refrigerator appliance, maintaining the chilled chamber at the desired temperature.

Thus, certain refrigeration appliances may include one or more air vents that define the opening into the chilled chamber to allow for proper air flow. However, during operation of the refrigeration appliance, excess moisture and/or frost can accumulate in and around the air vent(s). As the moisture and/frost continues to accumulate, the air vents are not able to operate as designed. Furthermore, if the air vent(s) become blocked, airflow will decrease in temperature and moisture issues may arise due to blocked vents.

Accordingly, an improved air vent for a refrigeration appliances with features configured to reduce the amount of moisture and/or frost accumulation during operation of the appliance would be useful.

BRIEF DESCRIPTION OF THE INVENTION

Aspects and advantages of the invention will be set forth in part in the following description, or may be obvious from the description, or may be learned through practice of the invention.

In one aspect, the present disclosure is directed to a refrigeration appliance. The refrigeration appliance includes a cabinet having a plurality of walls that define a chilled chamber, a door attached to the cabinet to selectively restrict access to the chilled chamber, a cooling system for providing cool air to the chilled chamber via a duct extending through a wall of the plurality of walls of the chilled chamber, and at least one air vent positioned at an end of the duct. Further, the air vent(s) is mounted to the wall. Moreover, the air vent(s) has a body defining an opening through which the cool air exits during operation of the refrigeration appliance. The body of the air vent(s) further defines an outer perimeter having at least one discontinuity that creates at least one airflow passage between the body and the wall to reduce moisture in the chilled chamber.

In another aspect, the present disclosure is directed to an air vent for a refrigeration appliance. The air vent includes a body defining an opening through which the cool air passes therethrough during operation of the refrigeration appliance. The body further defines an outer perimeter defined by a plurality of side edges. Further, one or more of the plurality of side edges comprises at least one discontinuity that creates at least one airflow passage for reducing moisture within a chilled chamber of the refrigeration appliance during operation of the refrigeration appliance.

In yet another aspect, the present disclosure is directed to a refrigeration appliance. The refrigeration appliance includes a cabinet having a plurality of walls that define a chilled chamber, a door attached to the cabinet to selectively restrict access to the chilled chamber, a cooling system for providing cool air to the chilled chamber via a duct extending through a wall of the plurality of walls of the chilled chamber, and at least one air vent positioned at an end of the duct. Further, the air vent(s) has a body defining an opening through which the cool air exits during operation of the refrigeration appliance. Moreover, the body of the air vent(s) is mounted to the wall such that one or more airflow passages are created between the body and the wall to reduce moisture in the chilled chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
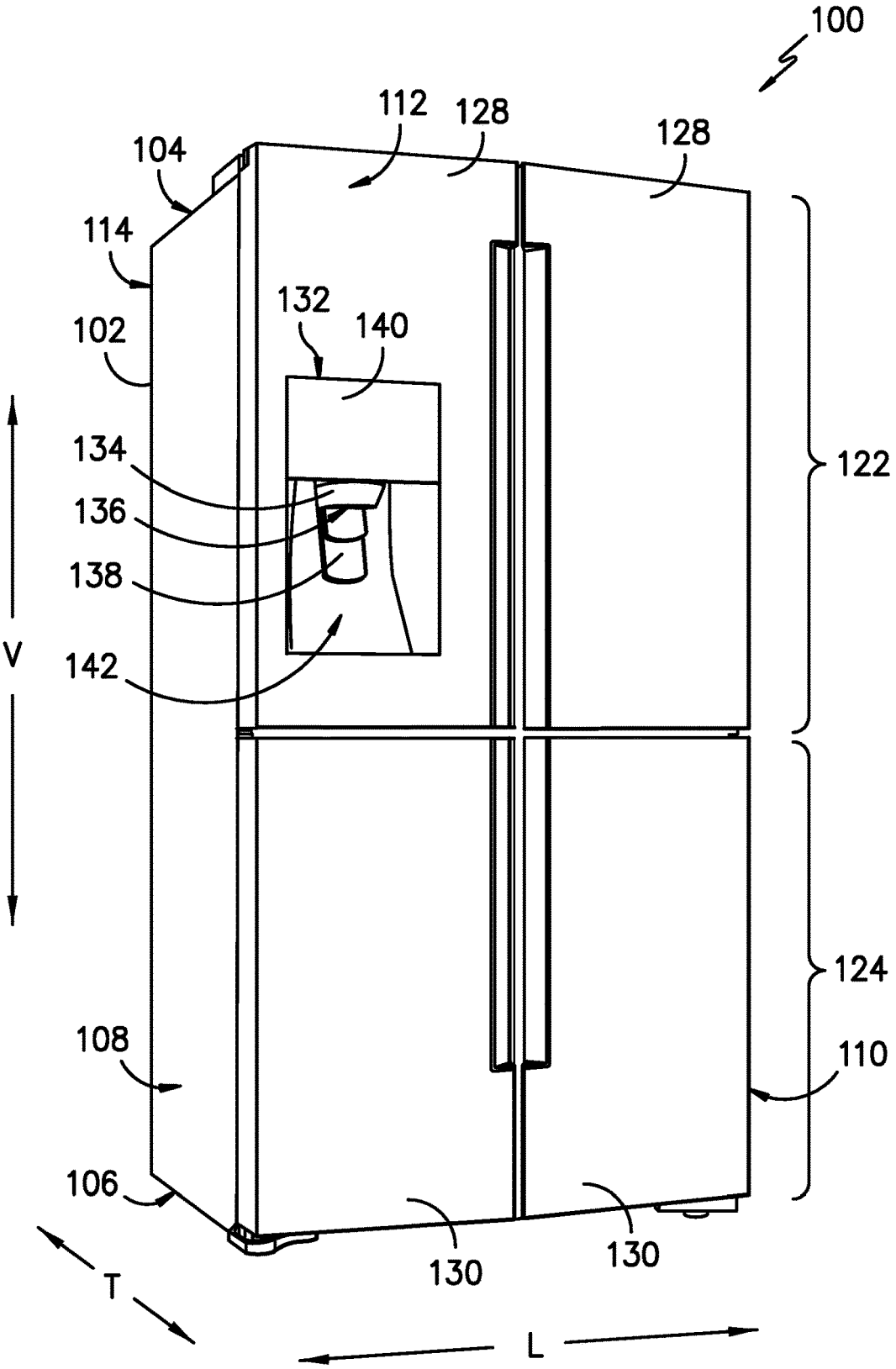
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Referring now to the drawings, FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. Similarly, freezer doors 130 are rotatably hinged to an edge of housing 102 for selectively accessing freezer chamber 124. To prevent leakage of cool air, refrigerator doors 128, freezer doors 130, and/or housing 102 may define one or more sealing mechanisms (e.g., rubber gaskets, not shown) at the interface where the doors 128, 130 meet housing 102. Refrigerator doors 128 and freezer doors 130 are shown in the closed configuration in FIG. 1 and in the open configuration in FIG. 2. It should be appreciated that doors having a different style, position, or configuration are possible and within the scope of the present subject matter.

Refrigerator appliance 100 may also include a dispensing assembly 132 for dispensing liquid water and/or ice. Dispensing assembly 132 includes a dispenser 134 positioned on or mounted to an exterior portion of refrigerator appliance 100, e.g., on one of refrigerator doors 128. Dispenser 134 includes a discharging outlet 136 for accessing ice and liquid water. An actuating mechanism 138, shown as a paddle, is mounted below discharging outlet 136 for operating dispenser 134. In alternative exemplary embodiments, any suitable actuating mechanism may be used to operate dispenser 134. For example, dispenser 134 can include a sensor (such as an ultrasonic sensor) or a button rather than the paddle. A control panel 140 is provided for controlling the mode of operation. For example, control panel 140 includes a plurality of user inputs (not labeled), such as a water dispensing button and an ice-dispensing button, for selecting a desired mode of operation such as crushed or non-crushed ice.

Discharging outlet 136 and actuating mechanism 138 are an external part of dispenser 134 and are mounted in a dispenser recess 142. Dispenser recess 142 is positioned at a predetermined elevation convenient for a user to access ice or water and enabling the user to access ice without the need to bend-over and without the need to open refrigerator doors 128. In the exemplary embodiment, dispenser recess 142 is positioned at a level that approximates the chest level of a user. According to an exemplary embodiment, the dispensing assembly 132 may receive ice from an icemaker disposed in a sub-compartment of the fresh food chamber 122.

Figure 2:
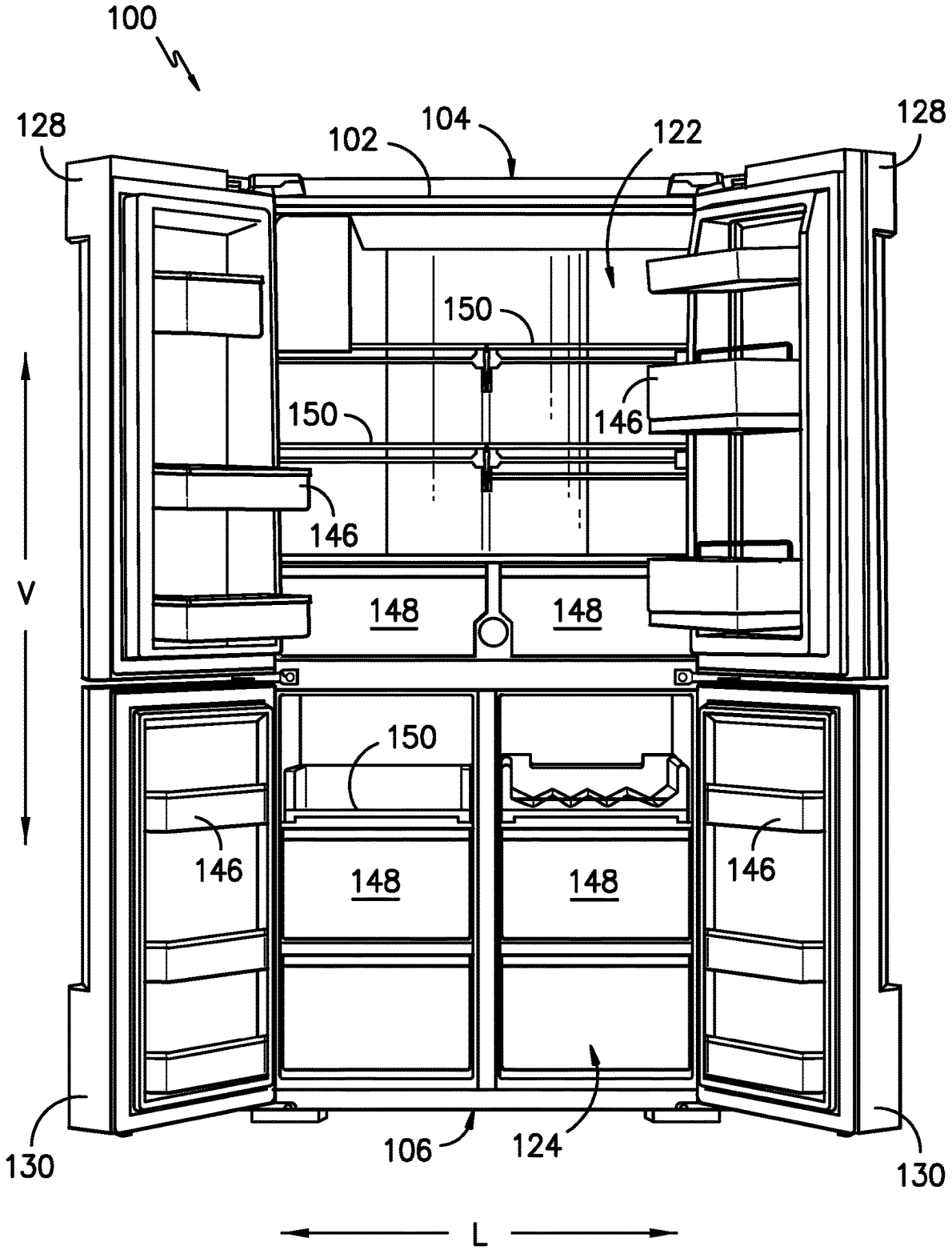
FIG. 2 provides a front view of the exemplary refrigerator appliance of FIG. 1 with the refrigerator and freezer doors shown in an open position.

Referring now to FIG. 2, a front view of refrigerator appliance 100 with refrigerator doors 128 and freezer doors 130 shown in an open position. According to the illustrated embodiment, various storage components are mounted within fresh food chamber 122 and freezer chamber 124 to facilitate storage of food items therein as will be understood by those skilled in the art. In particular, the storage components include bins 146, drawers 148, and shelves 150 that are mounted within fresh food chamber 122 or freezer chamber 124. Bins 146, drawers 148, and shelves 150 are configured for receipt of food items (e.g., beverages and/or solid food items) and may assist with organizing such food items. As an example, drawers 148 can receive fresh food items (e.g., vegetables, fruits, and/or cheeses) and increase the useful life of such fresh food items.

Figure 3:
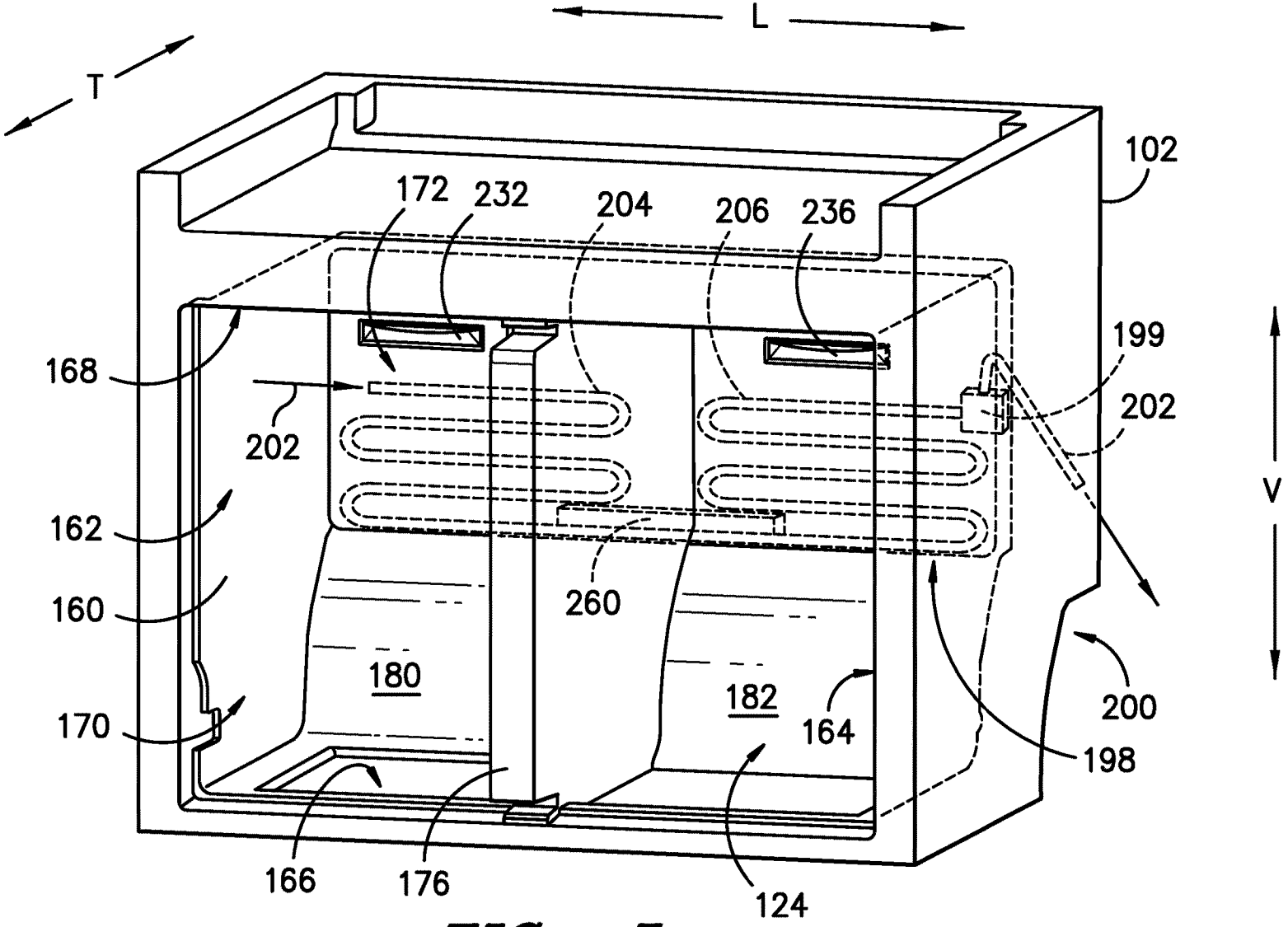
FIG. 3 provides a perspective view of a freezer chamber of the exemplary refrigerator appliance of FIG. 1 with the freezer doors and storage bins removed for clarity according to an exemplary embodiment of the present subject matter.
Figure 4:
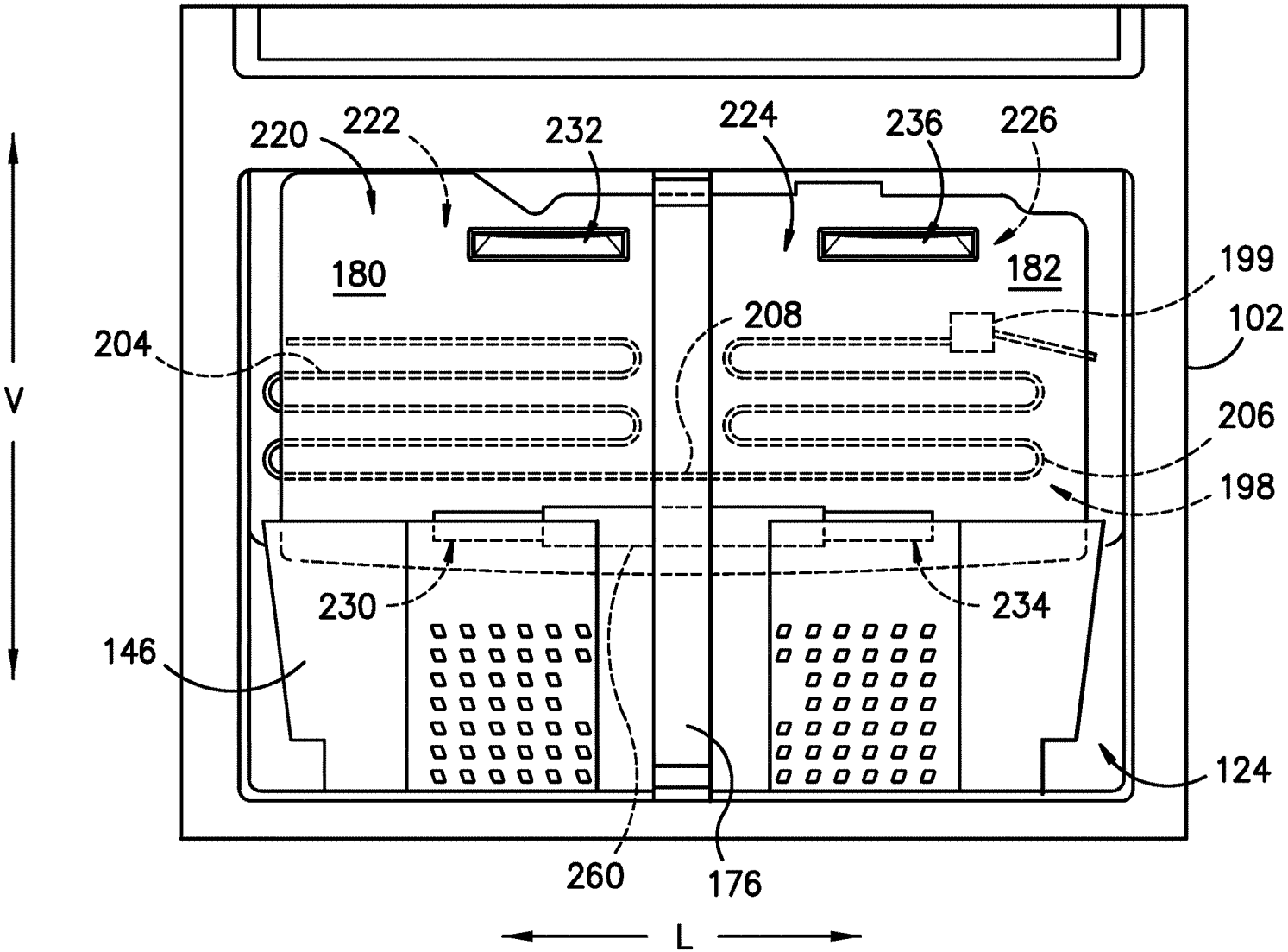
FIG. 4 provides a front view of the exemplary freezer chamber of FIG. 3.

Referring now to FIGS. 3 and 4, freezer chamber 124 will be described according to exemplary an exemplary embodiment of the present subject matter. As illustrated, cabinet or housing 102 includes an inner liner 160 which defines freezer chamber 124. For example, inner liner 160 may be an injection-molded door liner attached to an inside of housing 102. Insulation (not shown), such as expandable foam can be present between housing 102 and inner liner 160 in order to assist with insulating freezer chamber 124. For example, sprayed polyurethane foam may be injected into a cavity defined between housing 102 and inner liner 160 after they are assembled. Freezer doors 130 may be constructed in a similar manner to assist in insulating freezer chamber 124.

Freezer chamber 124 generally extends between a left wall 162 and a right wall 164 along the lateral direction L, between a bottom wall 166 and a top wall 168 along the vertical direction V, and between a chamber opening 170 and a back wall 172 along the transverse direction T. Refrigerator appliance 100 may further include a mullion 176 positioned within freezer chamber 124 to divide freezer chamber 124 into a first freezer compartment 180 and a second freezer compartment 182. According to the illustrated embodiment, mullion 176 generally extends between chamber opening 170 and back wall 172 along the transverse direction T and between bottom wall 166 and top wall 168 along the vertical direction V. In this manner, mullion 176 is generally vertically-oriented and splits freezer chamber 124 into two equally-sized compartments 180, 182.

To limit heat transfer between first freezer compartment 180 and second freezer compartment 182, mullion 176 may generally be formed from an insulating material such as foam. In addition, to provide structural support, a rigid injection molded liner or a metal frame may surround the insulating foam. According to another exemplary embodiment, mullion 176 may be a vacuum insulated panel or may contain a vacuum insulated panel to minimize heat transfer between first freezer compartment 180 and second freezer compartment 182. According to an exemplary embodiment, inner liner 160 and/or mullion 176 may include features such as guides or slides, e.g., to ensure proper positioning, installation, and sealing of mullion 176 within inner liner 160.

A seal, such as a rubber or foam gasket (not shown), may be positioned around a perimeter of mullion 176 where it contacts inner liner 160 and/or freezer doors 130. In addition, mullion 176 can be formed to have the same shape as inner liner 160 such that a tight seal is formed when mullion 176 is installed. However, as further described below, mullion 176 may further include recesses, apertures, or passageways where needed to allow refrigeration system components to pass through mullion 176.

According to the exemplary embodiment, mullion 176 is removable such that inner liner 160 may be formed in the same shape as conventional single compartment freezer chambers. In this manner, the same tooling may be used to form both refrigerator appliances, thereby reducing costs. Although mullion 176 is illustrated as extending vertically through a middle of freezer chamber 124, it should be appreciated that mullion 176 may be sized, positioned, and configured in any suitable manner to form separate freezer sub-compartments within freezer chamber 124.

Figure 5:
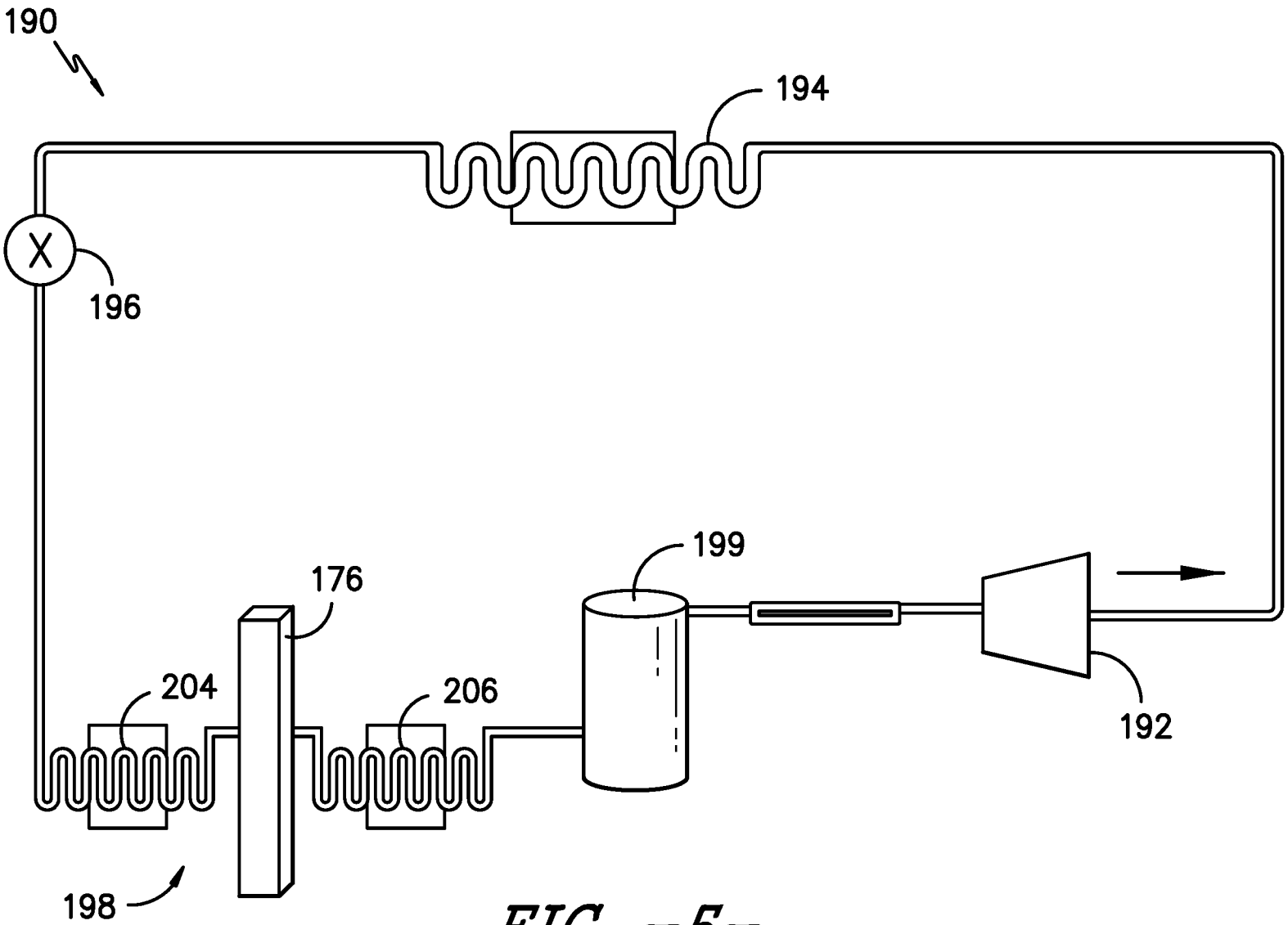
FIG. 5 provides a schematic view of a sealed cooling system configured for cooling the exemplary freezer chamber of FIG. 3 according to an exemplary embodiment of the present subject matter.

Referring now to FIG. 5, a schematic view of an exemplary cooling system 190 which may be used to cool freezer chamber 124 will be described. It should be understood that the cooling system 190 is provided for illustrated purposes only. Thus, other types of cooling systems may also be employed, including, for example, Stirling Cycle, Thermelectrics, etc. Cooling system 190 is generally configured for executing a vapor compression cycle for cooling air within refrigerator appliance 100, e.g., within fresh food chamber 122 and freezer chamber 124. As shown, the cooling system 190 includes a compressor 192, a condenser 194, an expansion device 196, and an evaporator 198 connected in series and charged with a refrigerant.

During operation of cooling system 190, gaseous refrigerant flows into compressor 192, which operates to increase the pressure of the refrigerant. This compression of the refrigerant raises its temperature, which is lowered by passing the gaseous refrigerant through condenser 194. Within condenser 194, heat exchange with ambient air takes place so as to cool the refrigerant and cause the refrigerant to condense to a liquid state.

Expansion device (e.g., a valve, capillary tube, or other restriction device) 196 receives liquid refrigerant from condenser 194. From expansion device 196, the liquid refrigerant enters evaporator 198. Upon exiting expansion device 196 and entering evaporator 198, the liquid refrigerant drops in pressure and vaporizes. Due to the pressure drop and phase change of the refrigerant, evaporator 198 is cool relative to fresh food and freezer chambers 122 and 124 of refrigerator appliance 100. As such, cooled air is produced and refrigerates fresh food and freezer chambers 122 and 124 of refrigerator appliance 100. Thus, evaporator 198 is a type of heat exchanger which transfers heat from air passing over evaporator 198 to refrigerant flowing through evaporator 198.

It should be appreciated that the illustrated cooling system 190 is only one exemplary configuration of cooling system 190 which may include additional components, e.g., one or more additional evaporators, compressors, expansion devices, and/or condensers. As an example, cooling system 190 may include two evaporators. As a further example, cooling system 190 may further include an accumulator 199 positioned downstream of evaporator 198, which may be configured to collect condensed refrigerant from the refrigerant stream prior to passing it to compressor 192.

Referring again generally to FIGS. 3 and 4, evaporator 198 may be positioned adjacent back wall 172 of inner liner 160. The remaining components of cooling system 190 are typically located within a machinery compartment 200 of refrigerator appliance 100. A conduit 202 may pass refrigerant into freezer chamber 124 to evaporator 198 through a fluid tight inlet and may pass refrigerant from evaporator 198 out of freezer chamber 124 through a fluid tight outlet.

According to the illustrated embodiment, evaporator 198 may include a first evaporator section 204 and a second evaporator section 206. First evaporator section 204 and second evaporator section 206 are connected in series such that refrigerant passes first through first evaporator section 204 before second evaporator section 206. More specifically, according to the illustrated embodiment, first evaporator section 204 and second evaporator section 206 are coupled by a transition tube 208. Transition tube 208 may be a separate connecting conduit or a part of the same tube forming evaporator 198. As illustrated, first evaporator section 204 is positioned within first freezer compartment 180 and second evaporator section 206 is positioned within second freezer compartment 182.

An evaporator cover is typically placed over evaporator 198 to form an evaporator chamber within inner liner 160. For example, as illustrated, a first evaporator cover 220 is positioned within first freezer compartment 180 over evaporator 198, or more specifically, over first evaporator section 204. In this manner, inner liner 160, mullion 176, and first evaporator cover 220 define a first evaporator chamber 222 which houses first evaporator section 204. Similarly, a second evaporator cover 224 is positioned within second freezer compartment 182 over evaporator 198, or more specifically, over second evaporator section 206. In this manner, inner liner 160, mullion 176, and second evaporator cover 224 define a second evaporator chamber 226 which houses second evaporator section 206.

Evaporator chambers 222, 226 generally include one or more return ducts and supply ducts to allow air to circulate to and from first freezer compartment 180 and second freezer compartment 182. For example, as shown in FIG. 4, first evaporator cover 220 defines a first return duct 230 for allowing air to enter first evaporator chamber 222 and a first supply duct 232 for exhausting air out of first evaporator chamber 222 into first freezer compartment 180. Similarly, second evaporator cover 224 defines a second return duct 234 for allowing air to enter second evaporator chamber 226 and a second supply duct 236 for exhausting air out of second evaporator chamber 226 into second freezer compartment 182.

According to the illustrated embodiment, first return duct 230 and second return duct 234 are positioned proximate a bottom of freezer chamber 124 (e.g., proximate bottom wall 166) and first supply duct 232 and second supply duct 236 are positioned proximate a top of freezer chamber 124 (e.g., proximate top wall 168). It should be appreciated, however, that according to alternative embodiments, any other suitable means for providing fluid communication between the evaporator chambers and the freezer compartments are possible and within the scope of the present subject matter.

Figure 6:
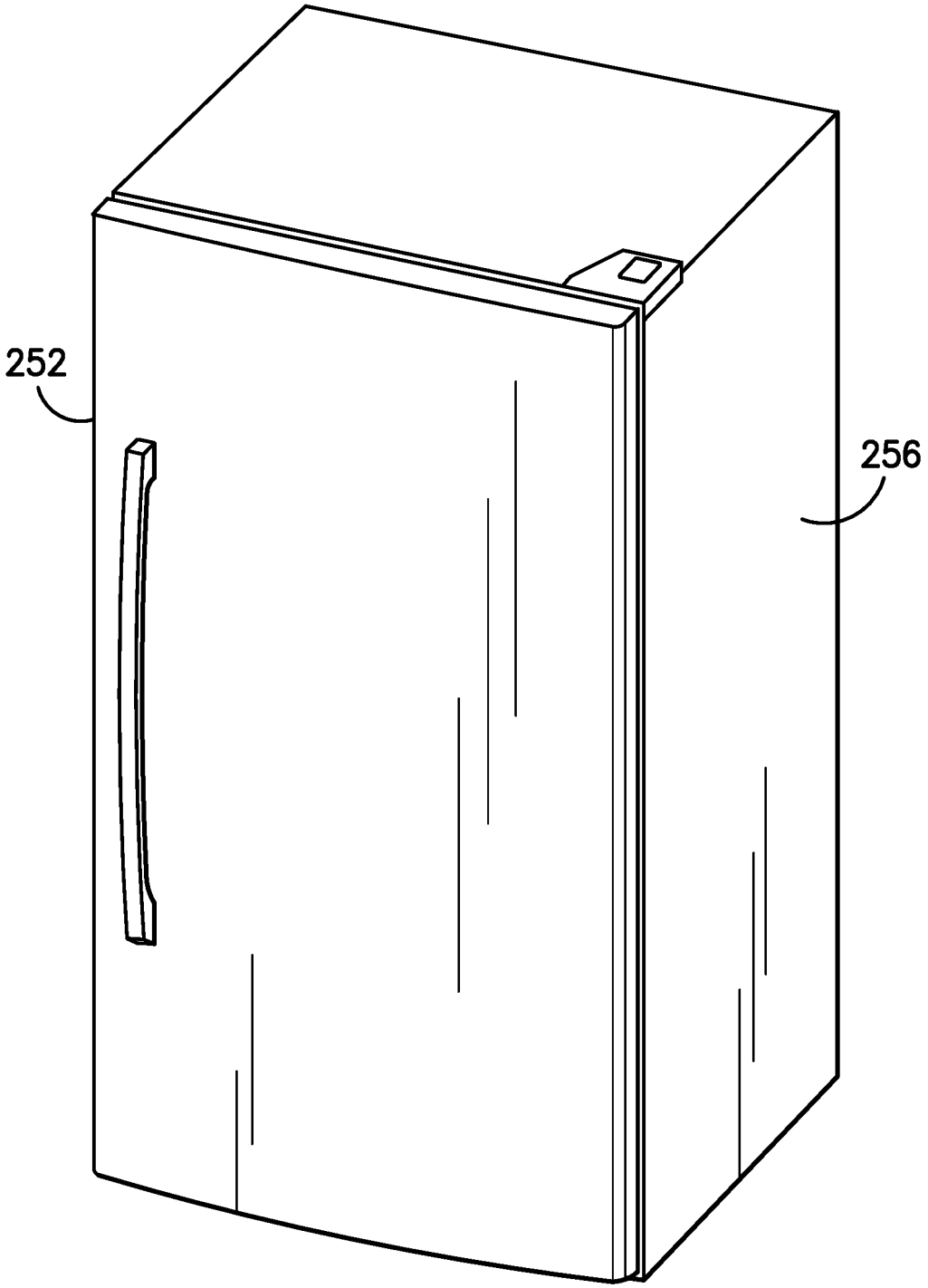
FIG. 6 provides a front view of a standalone freezer appliance according to an exemplary embodiment of the present subject matter.
Figure 7:
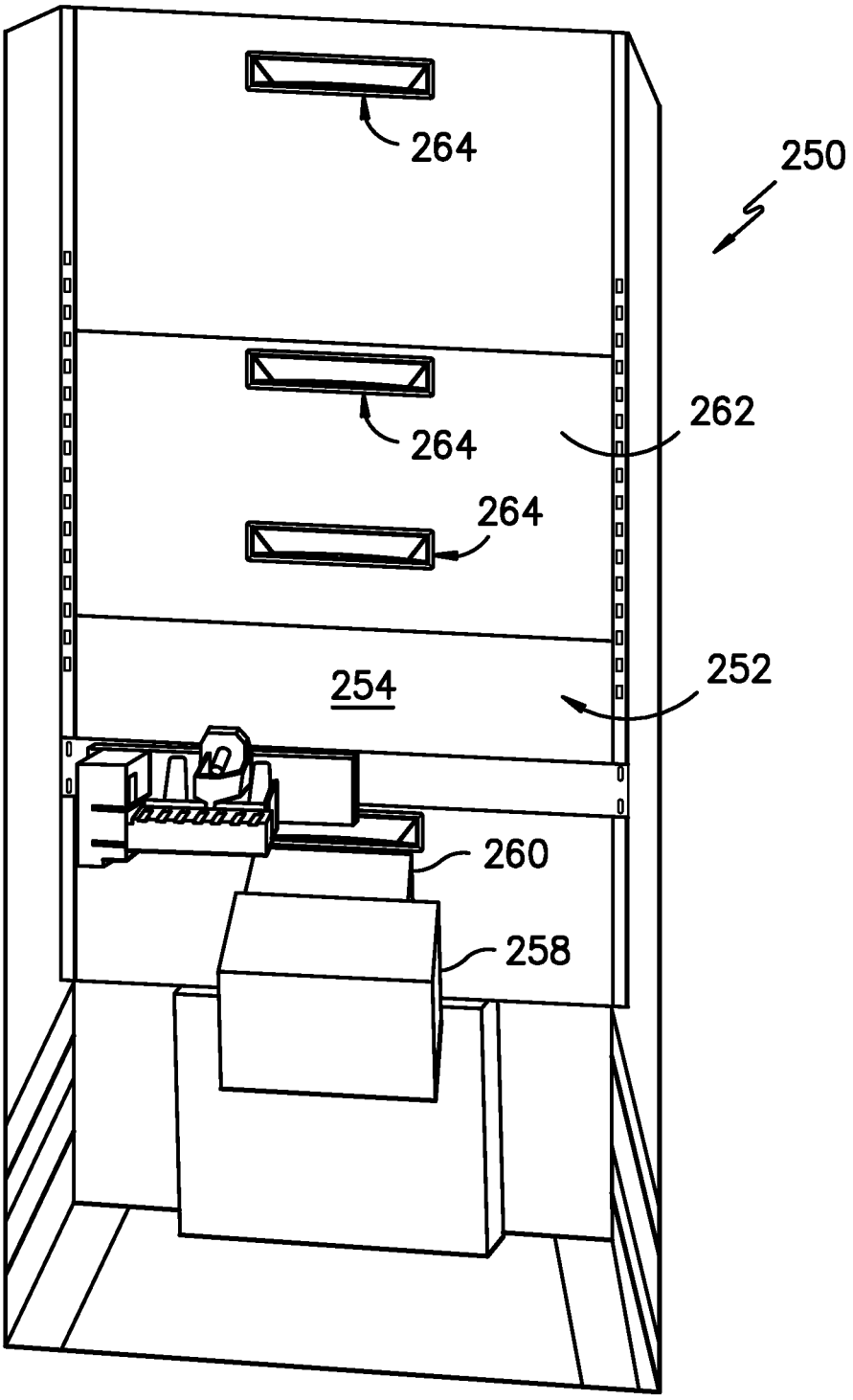
FIG. 7 provides an internal view of the standalone freezer appliance of FIG. 6.
Figure 8:
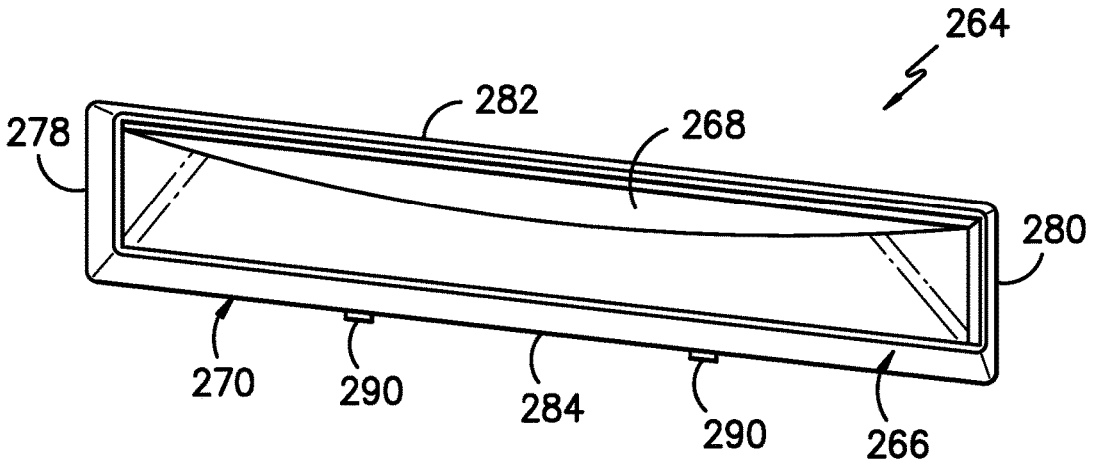
FIG. 8 provides a perspective view of an air vent for a refrigeration appliance according to an exemplary embodiment of the present subject matter.

For example, as shown in FIGS. 6 and 7, a standalone freezer appliance 250 is illustrated according to the present disclosure. In particular, as shown, the standalone freezer 250 can be configured similar to and may be operated similar to that of the freezer chamber 124 described in FIGS. 1-5. For example, as shown, the standalone freezer 250 may include a cabinet 252 having a plurality of walls that define a chilled chamber 254. Moreover, as shown in FIG. 6, the standalone freezer 250 may further include a door 256 attached to the cabinet 252 to selectively restrict access to the chilled chamber 254. In addition, as shown, the standalone freezer 250 may include a cooling system 258 for providing cool air to the chilled chamber 254 via a duct 260 extending through a wall 262 of the chilled chamber 254. Thus, as shown, the standalone freezer 250 further includes at least one air vent 264 positioned at an end of the duct 260 and mounted to the wall 262. For example, as shown, the standalone freezer 250 includes three air vents 264. In further embodiments, it should be understood that the standalone freezer 250 may include more than three air vents or less than three air vents.

Referring now to FIGS. 8-16, various views of different embodiments of the air vent 264 according to the present disclosure are illustrated. As shown, the air vent 264 generally has a body 266 defining an opening 268 through which the cool air exits during operation of the refrigeration appliance 100. Furthermore, as shown, the body 266 of the air vent 264 further defines an outer perimeter 270 defining an outermost body of the air vent 264. In particular embodiments, as shown in FIGS. 8-16, the outer perimeter 270 of the air vent(s) 264 may be defined by four edges 278, 280, 282, 284 having two side edges 278, 280, an upper edge 282, and a lower edge 284.

Figure 9:
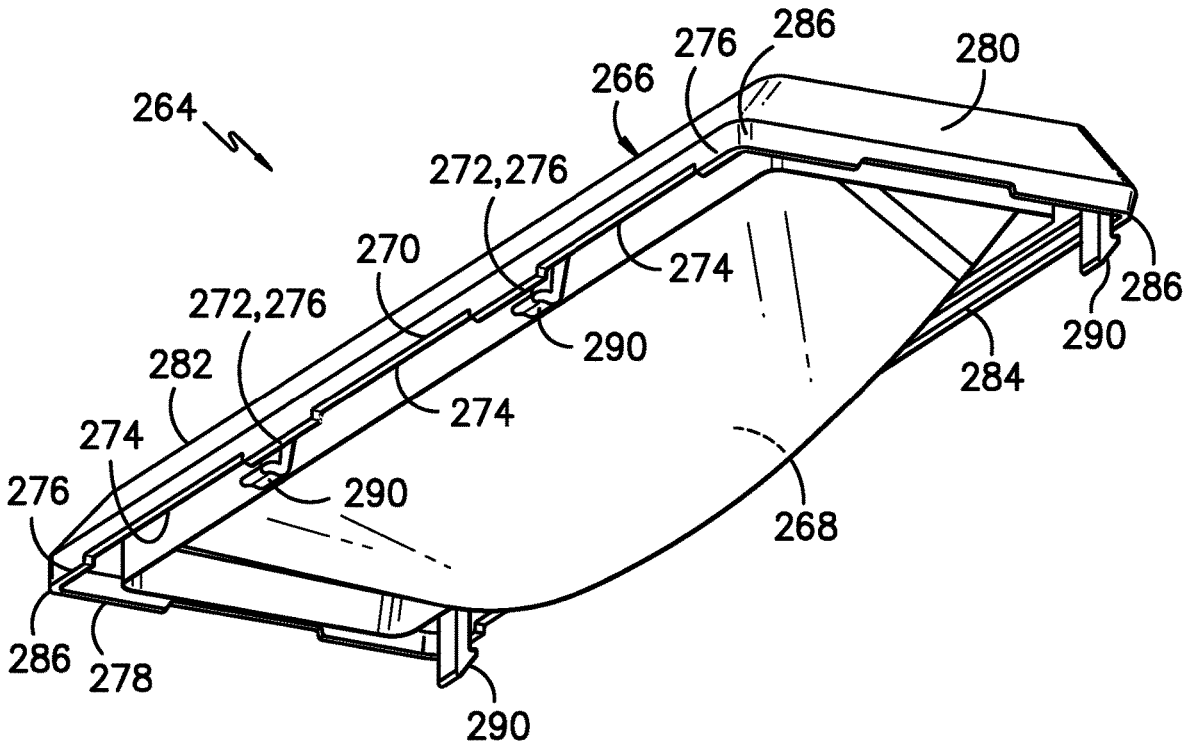
FIG. 9 provides another perspective view of an air vent for a refrigeration appliance according to an exemplary embodiment of the present subject matter.
Figure 12:
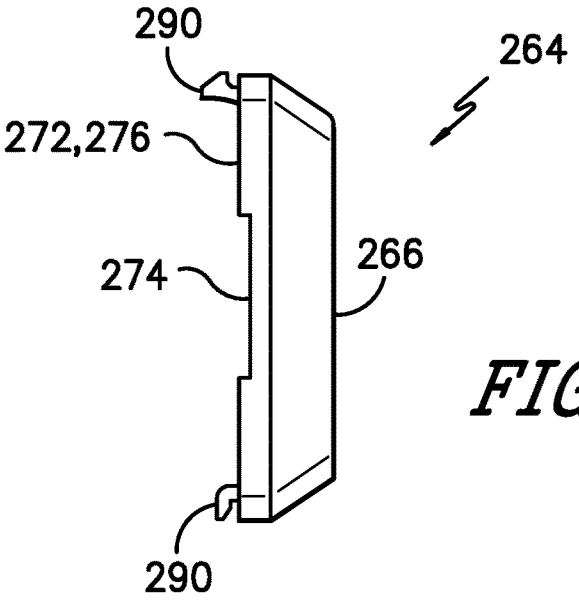
FIG. 12 provides a side view of the air vent of FIG. 10.
Figure 16:
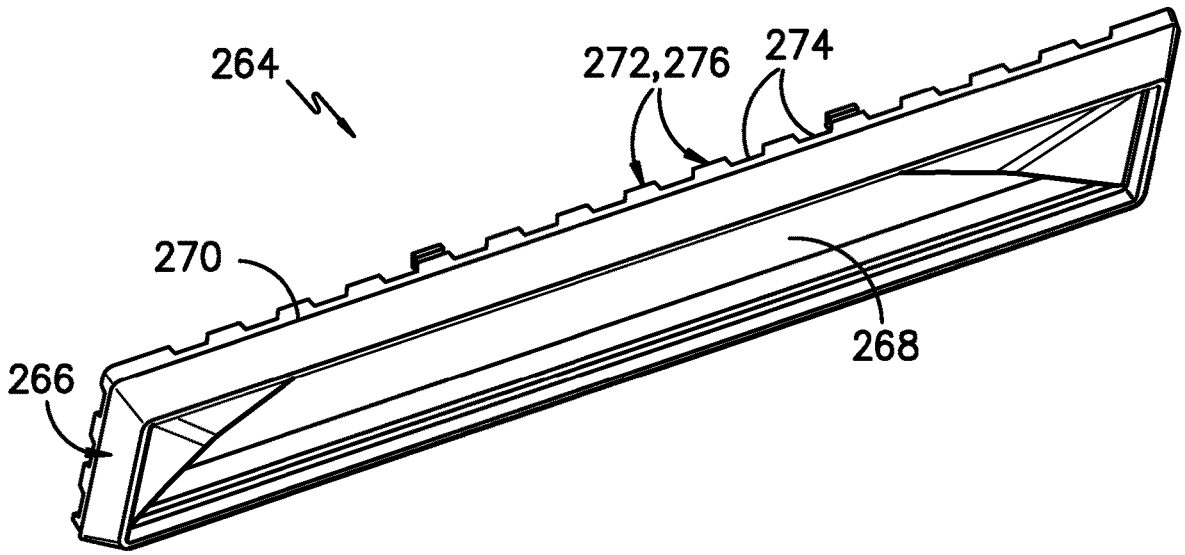
FIG. 16 provides a perspective view of the air vent of FIG. 16.

Accordingly, as shown particularly in FIGS. 9, 12, 14, and 16, the outer perimeter 270 of the body 266 of the air vent 264 further includes at least one discontinuity 272. Thus, when mounted to the wall 262 of the refrigeration appliance 100, the discontinuity(ies) 272 creates at least one airflow passage 274 between the body 266 and the wall 262 to reduce moisture in the cabinet 252. More specifically, as shown, the discontinuity(ies) 272 may include a plurality of ribs 276 or protrusions that create a plurality of the airflow passages 274 between the body 266 and the wall 262 of the refrigeration appliance 100. In such embodiments, the plurality of ribs 276 may have any suitable cross-sectional shape. For example, the cross-sectional shape may be a square, a rectangle, a trapezoid, a triangle, a semi-ellipse (such as a semi-circle or semi-ellipse), or similar. In particular embodiments, as shown in FIGS. 9 and 12, the cross-sectional shape of the plurality of ribs 276 is substantially rectangular. In another embodiment, as shown in FIG. 16, the cross-sectional shape of the plurality of ribs 276 is substantially trapezoidal.

Figure 14:
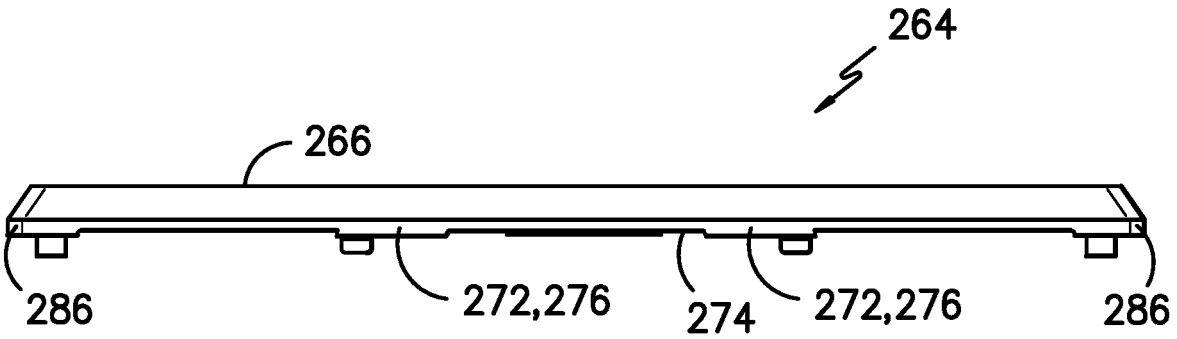
FIG. 14 provides a side view of the air vent of FIG. 10.
Figure 15:
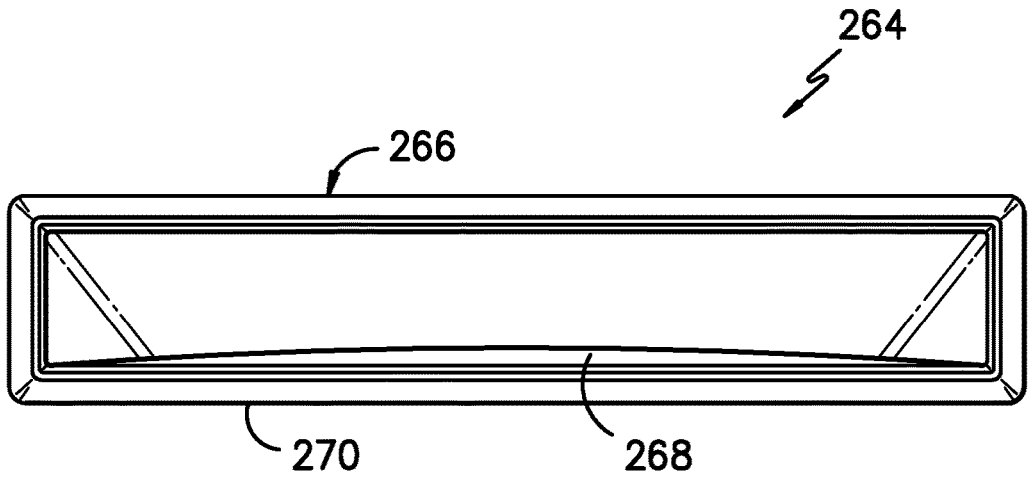
FIG. 15 provides a front view of an air vent for a refrigeration appliance according to an exemplary embodiment of the present subject matter.

Moreover, the ribs 276 may have any suitable size and/or spacing to provide the desired flow rate through the airflow passages 274. For example, as shown in FIGS. 8-14, the size of the airflow passages 274 are wide and narrow (i.e., the majority of a side of the body 266 of the air vent 264) encompasses the airflow passage(s) 274 rather than the ribs 276. In contrast, as shown in FIGS. 15 and 16, the size/width of the airflow passages 274 may be substantially equal to the width of the ribs 276.

In additional embodiments, as shown in FIGS. 8-12, each of the four edges 278, 280, 282, 284 of the body 266 may have at least one of the plurality of ribs 276 formed therein. In such embodiments, the two side edges 278, 280 may each include two of the plurality of ribs 276 to define one of the plurality of airflow passages 274 between the body 266 and the wall 262.

Figure 10:
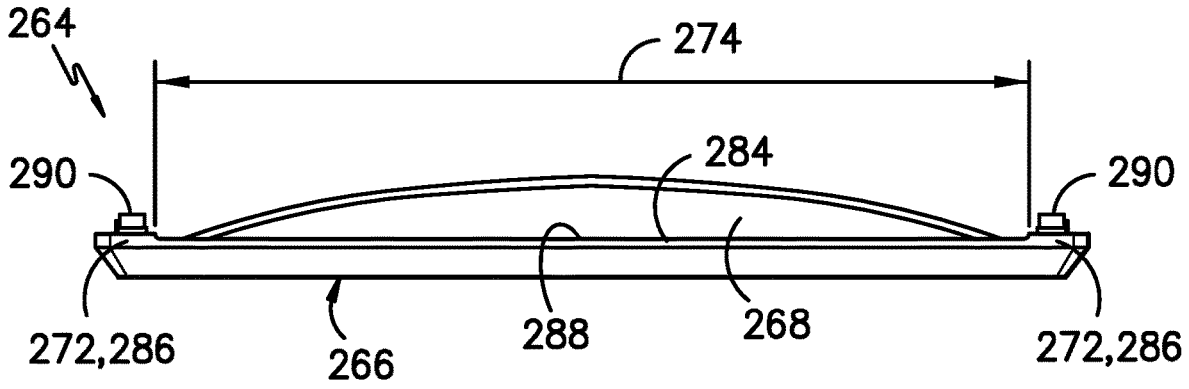
FIG. 10 provides a rear, elevation view of an air vent for a refrigeration appliance according to an exemplary embodiment of the present subject matter.

In further embodiments, as shown particularly in FIG. 9, the upper edge 282 of the body 266 may include four of the ribs 276 to define three of the plurality of airflow passages 274 between the body and the wall 262. Furthermore, as shown in FIG. 10, the lower edge 284 may include two end ribs 286 that define a single, long airflow passage 274. In addition, as shown in FIGS. 9, 10, and 14, the end ribs 286 may be located at the corners of the body 266 of the air vent(s) 264 and may be curved ribs 286. In such embodiments, as shown, each of the curved ribs 286 may be formed of an end rib on one of the upper and lower edges 282, 284 and an end rib of one of the two side edges 278, 280.

Figure 11:
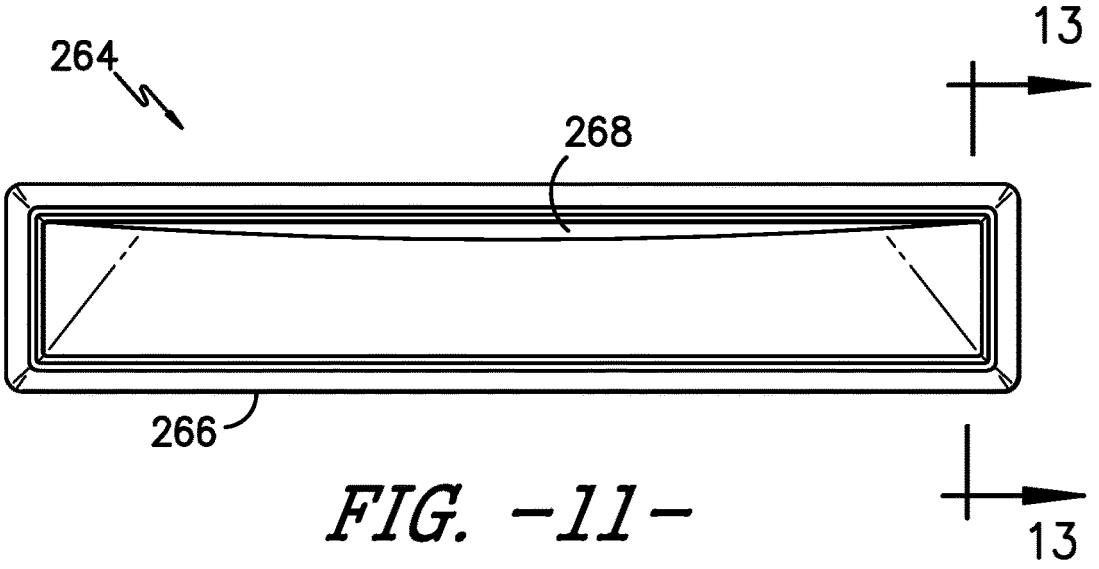
FIG. 11 provides a front view of the air vent of FIG. 10.

In another embodiment, as shown in FIGS. 10 and 11, a surface 288 of the airflow passage(s) 274 may define a taper or draft angle to reduce visibility of the airflow passages 274 from a front view of the air vent(s) 264 (e.g., as shown in FIG. 11).

Figure 13:
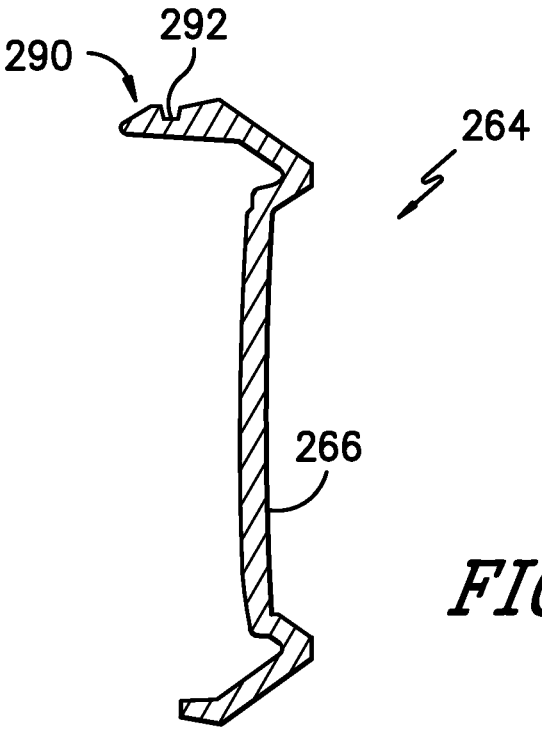
FIG. 13 provides a cross-sectional view of the air vent of FIG. 10 along line 13-13.

In still further embodiments, as shown in FIGS. 8-10, and 12-13, the body 266 of the air vent(s) 264 may include one or more clip members 290, for example, for securing the air vent(s) 264 at the end of the duct in the wall 262 of the refrigeration appliance 100. In particular, as shown in FIG. 13, the clip member(s) 290 may include a notch 292 for receiving the wall 262 and holding the air vent 264 in place.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigeration appliance, comprising:

a cabinet comprising a plurality of walls that define a chilled chamber;

a door attached to the cabinet to selectively restrict access to the chilled chamber;

a cooling system for providing cool air to the chilled chamber via a duct extending through a wall of the plurality of walls of the chilled chamber; and at least one air vent positioned at an end of the duct and mounted to the wall, the at least one air vent comprising a body defining an opening through which the cool air exits during operation of the refrigeration appliance, the body of the at least one air vent further defining an outer perimeter comprising at least one discontinuity that creates at least one airflow passage between the body and the wall to reduce moisture in the chilled chamber.

2. The refrigeration appliance of claim 1, wherein the at least one discontinuity further comprises a plurality of ribs that create a plurality of airflow passages between the body and the wall.

3. The refrigeration appliance of claim 2, wherein the plurality of ribs each define a cross-sectional shape, the cross-sectional shape comprising at least one of a square, a rectangle, a trapezoid, a semi-ellipse, or a triangle.

4. The refrigeration appliance of claim 2, wherein the outer perimeter of the at least one air vent is defined by side edges, an upper edge, and a lower edge, each of the edges comprising at least one of the plurality of ribs.

5. The refrigeration appliance of claim 4, wherein the side edges each comprise two of the plurality of ribs to define one of the plurality of airflow passages between the body and the wall.

6. The refrigeration appliance of claim 5, wherein one of the upper and lower edges comprises four of the plurality of ribs to define three of the plurality of airflow passages between the body and the wall and the other the upper and lower edges comprises two of the plurality of ribs to define one of the plurality of airflow passages.

7. The refrigeration appliance of claim 6, wherein each corner of the body of the at least one air vent comprises a curved rib.

8. The refrigeration appliance of claim 7, wherein each of the curved ribs is formed of an end rib on one of the upper and lower edges and an end rib one of the side edges.

9. The refrigeration appliance of claim 1, wherein a surface of the at least one airflow passage defines a taper angle to reduce visibility of the at least one airflow passage from a front view of the at least one air vent.

10. The refrigeration appliance of claim 1, wherein the body of the at least one air vent further comprises one or more clip members for securing the at least one air vent at the end of the duct in the wall.

11. The refrigeration appliance of claim 1, wherein the refrigeration appliance comprises at least one of a refrigerator or a freezer.

12. A refrigeration appliance, comprising:

a cabinet comprising a plurality of walls that define a chilled chamber;

a door attached to the cabinet to selectively restrict access to the chilled chamber;

a cooling system for providing cool air to the chilled chamber via a duct extending through a wall of the plurality of walls of the chilled chamber; and at least one air vent positioned at an end of the duct and comprising a body defining an opening through which the cool air exits during operation of the refrigeration appliance, the body of the at least one air vent being mounted to the wall such that one or more airflow passages are created between the body and the wall to reduce moisture in the chilled chamber.

13. The refrigeration appliance of claim 12, wherein the body defines an outer perimeter comprising at least one discontinuity, the at least one discontinuity creating the one or more airflow passages between the body and the wall.

14. The refrigeration appliance of claim 13, wherein the at least one discontinuity further comprises a plurality of ribs that create a plurality of airflow passages between the body and the wall.

15. The refrigeration appliance of claim 14, wherein the plurality of ribs each define a cross-sectional shape, the cross-sectional shape comprising at least one of a square, a rectangle, a trapezoid, a semi-ellipse, or a triangle.

16. The refrigeration appliance of claim 14, wherein the outer perimeter of the at least one air vent is defined by side edges, an upper edge, and a lower edge, each of the edges comprising at least one of the plurality of ribs.

17. The refrigeration appliance of claim 16, wherein the side edges each comprise two of the plurality of ribs to define one of the plurality of airflow passages between the body and the wall.

18. The refrigeration appliance of claim 17, wherein one of the upper and lower edges comprises four of the plurality of ribs to define three of the plurality of airflow passages between the body and the wall and the other the upper and lower edges comprises two of the plurality of ribs to define one of the plurality of airflow passages.

19. The refrigeration appliance of claim 12, wherein a surface of at least one of the one or more airflow passages define a taper angle to reduce visibility thereof from a front view of the at least one air vent.

* * * * *